United States Patent [19]

Closset

[11] Patent Number: 4,937,044

[45] Date of Patent: Jun. 26, 1990

[54] STRONTIUM-MAGNESIUM-ALUMINUM MASTER ALLOY

[75] Inventor: Bernard Closset, Toronto, Canada

[73] Assignee: Timminco Limited, Toronto, Canada

[21] Appl. No.: 417,301

[22] Filed: Oct. 5, 1989

[51] Int. Cl.[5] ..... C22C 24/00

[52] U.S. Cl. ..... 420/415; 420/548; 420/580

[58] Field of Search ..... 420/415, 548, 580; 148/400, 442

[56] References Cited

U.S. PATENT DOCUMENTS

| | | | |
|---|---|---|---|
| 3,926,690 | 12/1975 | Morris et al. | 148/439 |
| 4,009,026 | 2/1977 | Rasmessen | 420/549 |
| 4,108,646 | 8/1978 | Gennone et al. | 420/415 |
| 4,185,999 | 1/1980 | Seese et al. | 420/549 |
| 4,394,348 | 7/1983 | Hardy et al. | 420/549 |

*Primary Examiner*—R. Dean

*Attorney, Agent, or Firm*—Jones, Tullar & Cooper

[57] ABSTRACT

A master alloy containing strontium magnesium and aluminum for modifying the aluminum-silicon eutectic phase of hypoeutectic, eutectic and hypereutectic aluminum-silicon based casting alloys.

8 Claims, 3 Drawing Sheets

STRONTIUM-MAGNESIUM-ALUMINUM MASTER ALLOY

BACKGROUND OF THE INVENTION

1. Field of the Invention

The present invention relates to master alloys for the modification of the micro-structure of aluminium-silicon casting alloys. Particularly, the present invention is related to a master alloy containing strontium, magnesium and aluminum for modifying the aluminum-silicon eutectic phase of hypoeutectic, eutectic and hypereutectic aluminum-silicon based casting alloys.

2. Discussion of the Background and Description of Related Art

The addition of strontium to other metals and alloys in order to improve the properties of the resultant alloy is known. Strontium is generally added to alloys either as a pure metal or in the form of a master alloy. The use of pure strontium has certain limitations. The metal readily oxidizes in a humid atmosphere and the presence of an oxide layer can inhibit the rate of dissolution of the strontium into the melt. Although the pure metal dissolves well in an aluminum-silicon-magnesium casting alloy melt between 675°-725° C., its dissolution rate decreases significantly at higher temperatures (725°-775° C.).

In U.S. Pat. No. 3,926,690, Morris et al. disclose that the addition of 0.01-0.5% strontium or calcium to an alloy of aluminum-magnesium-silicon provides an alloy with improved extrusion properties. In U.S. Pat. No. 4,394,348, Hardy et al. disclose the use of a master alloy containing strontium peroxide to introduce strontium into an aluminum bearing alloy to provide a finer grain alloy. Strontium is also known to be a superior modifier of the aluminum-silicon eutectic component of eutectic, hypereutectic and hypoeutectic aluminum-silicon casting alloys.

In U.S. Pat. No. 4,108,646, Gennone et al. disclose a powder or compact containing strontium-silicon and an aluminous material for use as a master composition. Strontium-containing master alloys are also disclosed in U.S. Pat. No. 4,009,026 and 4,185,999. British Pat. No. 1,520,673 discloses a master alloy of aluminum-silicon-strontium.

Known strontium master alloys, with increased amounts of strontium, have the disadvantage of low dissolution rates into aluminum-silicon casting alloys. Although master alloys with a lower strontium levels, such as aluminum-3.5% strontium, have rapid dissolution rates into aluminum-silicon casting alloys, larger quantities of the strontium containing master alloy must be added to achieve the desired strontium level in the melt.

SUMMARY OF THE INVENTION

It has been discovered that the addition of magnesium to an aluminum-strontium master alloy provides, in an alloy containing increased amounts of strontium, a master alloy with an enhanced rate of dissolution. Accordingly, the present invention provides a master alloy, for modifying the eutectic phase of aluminum-silicon casting alloys, consisting of 20-60% strontium, 5-40% magnesium and 5-40% aluminum. A preferred embodiment of the master alloy of invention contains 40-60% strontium, 10-30% magnesium and 10-30% aluminum. The shelf life of this alloy has been found to be acceptably long. It may also function as a source of magnesium for aluminum-silicon-magnesium casting alloys.

BRIEF DESCRIPTION OF THE DRAWINGS

The invention will now be discussed with reference to the following drawings, in which.

DETAILED DESCRIPTION OF THE PREFERRED EMBODIMENTS

The strontium-magnesium-aluminum master alloy in accordance with the present invention is produced by melting pure strontium, magnesium and aluminum in an iron crucible at temperatures between 750° and 800° C. The strontium-magnesium-aluminum master alloy is molten and cast under argon. The master alloy is preferably cast in the form of ingots, waffles, rods or bars.

Figure 1:
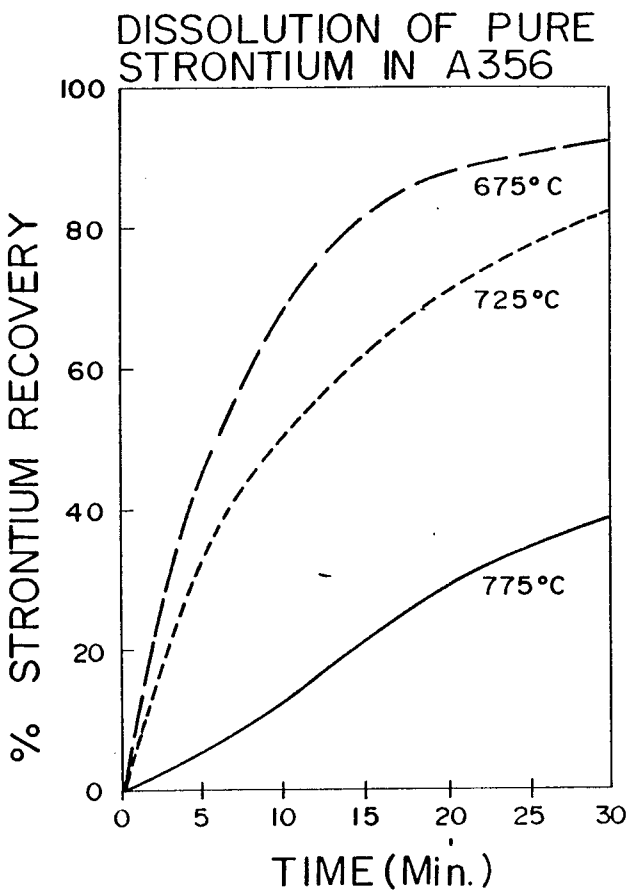
FIG. 1 is a graph showing, for a strontium level between 0.02% and 0.03%, the dissolution rates and strontium recovery of pure strontium added to an A356 melt at three different temperatures; 675° C., 725° C. and 775° C.
Figure 2:
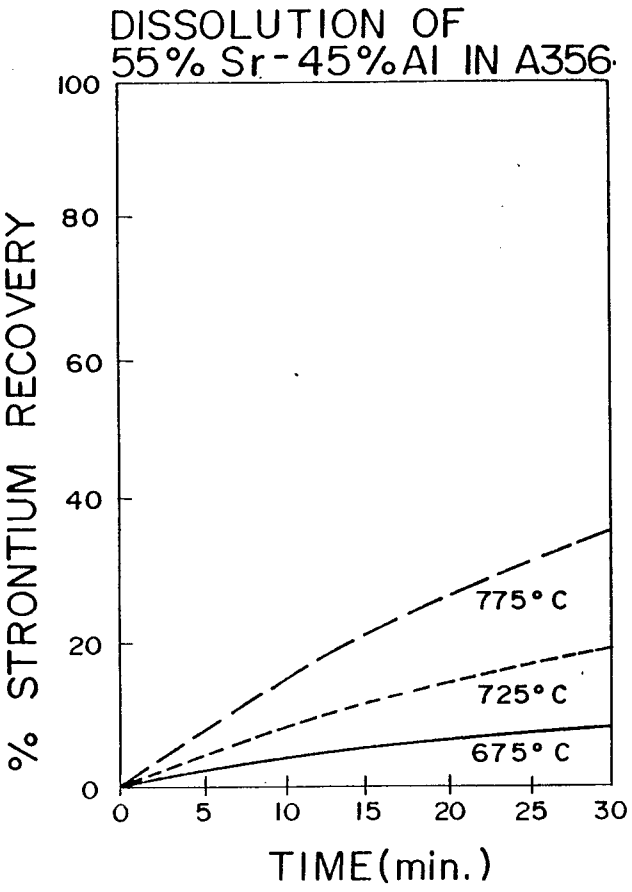
FIG. 2 is a graph showing, for a strontium level between 0.02 and 0.03%, the dissolution rates and strontium recovery, of a 55% strontium-45% aluminum master alloy added to an A356 melt at three different temperatures; 675° C., 725° C. and 775° C.
Figure 3:
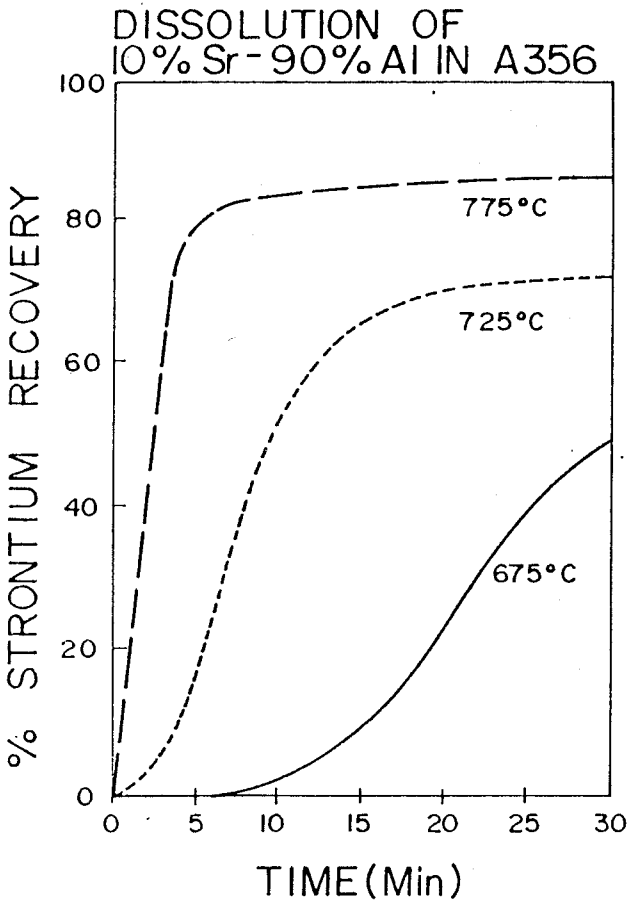
FIG. 3 is a graph showing, for a strontium level between 0.02 and 0.03%, the dissolution rates and strontium recovery of a 10% strontium-90% aluminum master alloy added to an A356 melt at three different temperatures; 675° C., 725° C. and 775° C.

FIGS. 1 to 4 show dissolution rates and recoveries of pure strontium and various master alloys containing strontium in A356 aluminum alloy melts. FIG. 1 shows the dissolution rates and recoveries of the addition of pure strontium in an A356 melt at three temperatures. The dissolution rate and recovery decrease with increasing melt temperatures. After thirty minutes, the recovery ranges from approximately 90% at 675° C. to approximately 35% at 775° C. FIG. 2 shows that a 55% strontium-45% aluminum master alloy dissolves very slowly in A356 alloys at the three temperatures shown. A decrease of strontium content in the master alloy improves the dissolution rate and recovery of strontium as shown in FIG. 3. However, only in the melt at 775° C. are good results achieved.

EXAMPLE 1

Various alloys within the scope of the invention were prepared and their liquidus and eutectic temperatures are shown in Table 1.

TABLE 1

| Alloy Composition | | | Liquidus Temperature | Eutectic Temperature |
|---|---|---|---|---|
| % Sr | % Mg | % Al | (°C.) | (°C.) |
| 50 | 25 | 25 | 720 | 610 |

TABLE 1-continued

| Alloy Composition | | | Liquidus Temperature | Eutectic Temperature |
|---|---|---|---|---|
| % Sr | % Mg | % Al | (°C.) | (°C.) |
| 55 | 30 | 15 | 650 | 610 |
| 55 | 25 | 20 | 675 | 610 |
| 60 | 30 | 10 | 655 | 610 |
| 60 | 20 | 20 | 710 | 610 |

It will be noted that the increase in the magnesium content decreases the melting temperature of the strontium-magnesium-aluminum master alloys. In the preferred embodiment, the percent magnesium in the master alloy will range from approximately 5 to 40%. It is believed that the reduction in melting temperature contributes to the enhancement of dissolution of the master alloy into A356 aluminum melts.

Figure 4:
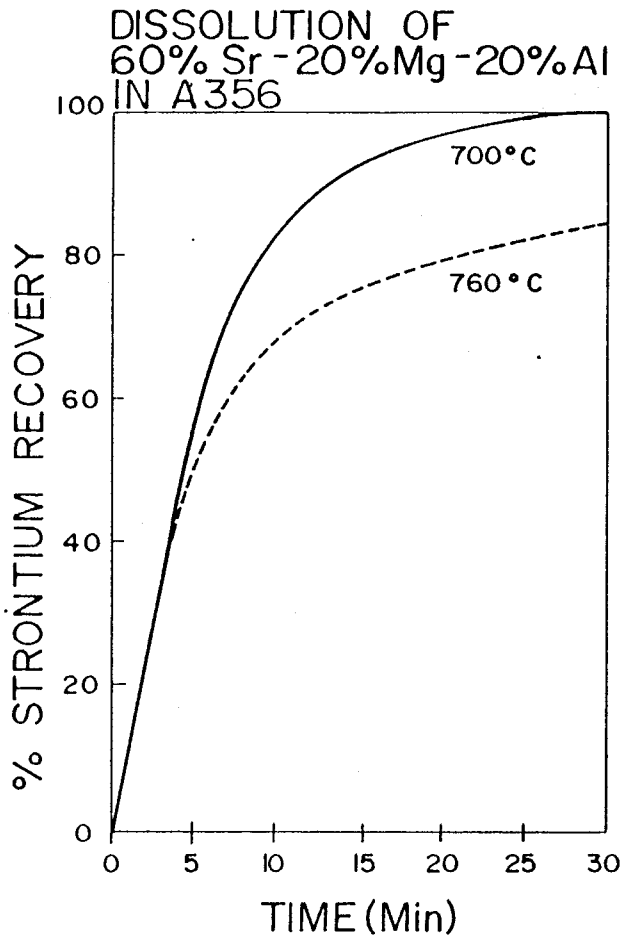
FIG. 4 is a graph showing, for a strontium level between 0.02% and 0.03%, the dissolution rates and strontium recovery by use of the strontium containing master alloy of the present invention which is added to an A356 melt at two different temperatures: 700° C. and 750° C.

Dissolution characteristics of one embodiment of the alloy of the invention are shown in FIG. 4. At both melt temperatures (700° C. and 750° C.) good dissolution rates and strontium recoveries are obtained. It is believed that the low melting point of the master alloy (710° C.) contributes to the improved dissolution characteristics.

Figure 5:
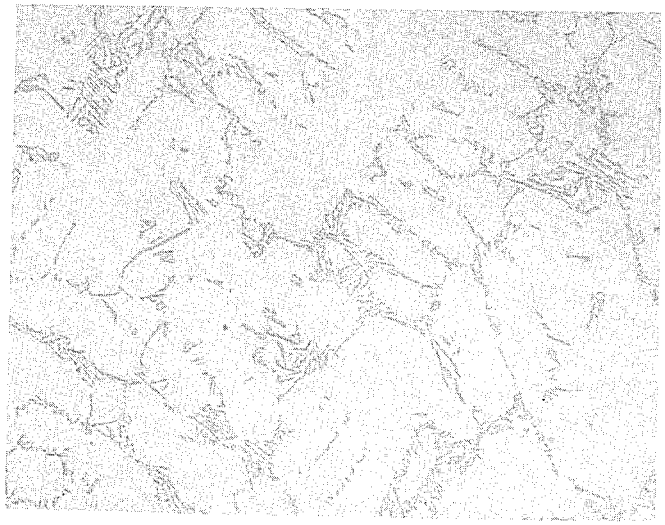
FIG. 5 is a photomicrograph of an Al, 7% Si, 0.3% Mg casting alloy which is unmodified.
Figure 6:
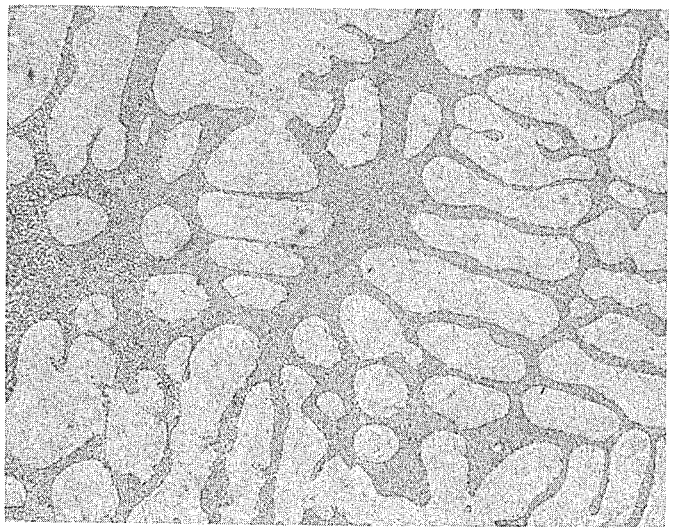
FIG. 6 is a photomicrograph of an Al, 7% Si, 0.3% Mg casting alloy which is modified by use of the Sr-Mg-Al master alloy of the present invention.

The effects of strontium on the microstructure of an A356 aluminum alloy are shown by comparison between FIGS. 5 and 6. At 0% strontium (FIG. 5), the eutectic composition contains coarse silicon particles. The addition of 0.025% strontium, changes the microstructure from acicular to fibrous (FIG. 6).

The invention is used by adding a sufficient quantity of the master alloy to an A356 melt to give a strontium level between 0.02% to 0.03% by weight. In typical casting of A356, the melt temperature is between 700° and 750° C. A holding time of thirty minutes is preferred. By this procedure, a finely dispersed eutectic is obtained.

The embodiments of the invention shown in Table 1 are illustrative of preferred embodiments thereof and are not intended to limit the scope of the invention. Various modifications of the invention will be obvious to those skilled in the art which may fall within the scope of the invention as defined in the following claims.

I claim:

1. A master alloy for modifying the eutectic phase of aluminum silicon casting alloys consisting of between 20 to 60% strontium, 5 to 40% magnesium and 5 to 40% aluminum.

2. The master alloy of claim 1 containing 40 to 60% strontium, 10 to 30% magnesium and 10 to 30% aluminum.

3. The master alloy of claim 1 containing 50% strontium.

4. The master alloy of claim 1 containing 15% to 25% magnesium.

5. The master alloy of claim 1 containing 15% to 25% aluminum.

6. The master alloy of claim 1 containing 50% strontium, 15 to 35% magnesium and 15 to 35% aluminum.

7. The master alloy of claim 1 in the form of an ingot, waffle, rod or bar.

8. A process for improving the micro-structure of an aluminum-silicon casting alloy comprising the steps of maintaining the casting alloy at a temperature in the range 700° to 750° C.; adding a master alloy consisting of between 20 to 60% strontium, 5 to 40% magnesium and 5 to 4% aluminum, holding the mixture molten for at least about 30 minutes and casting the alloy.

* * * * *